US007815397B1

(12) United States Patent
Dung

(10) Patent No.: US 7,815,397 B1
(45) Date of Patent: Oct. 19, 2010

(54) EXPANSION-SEALED FLOOD CONTROL GATE

(76) Inventor: Chen-Yuan Dung, 2F., No. 34, Alley 96, Lane 182, Yingtao Rd., Yingge Township (TW)

( * ) Notice: Subject to any disclaimer, the term of this patent is extended or adjusted under 35 U.S.C. 154(b) by 0 days.

(21) Appl. No.: 12/540,355

(22) Filed: Aug. 12, 2009

(51) Int. Cl.
*E02B 7/00* (2006.01)

(52) U.S. Cl. ..... 405/104; 405/107; 405/91; 405/87

(58) Field of Classification Search ..... 405/87, 405/90, 91, 98, 103, 104, 105, 106, 107, 405/115
See application file for complete search history.

(56) References Cited

U.S. PATENT DOCUMENTS 3,796,010 A * 3/1974 Carlson ..... 405/106
4,582,451 A * 4/1986 Hollander, Jr. ..... 405/105
4,934,868 A * 6/1990 Hellstrom et al. ..... 405/104
5,077,945 A * 1/1992 Koeniger ..... 405/114
5,460,462 A * 10/1995 Regan ..... 405/104
6,425,707 B1 * 7/2002 Baxter ..... 405/104
7,410,325 B1 * 8/2008 Nelson et al. ..... 405/104

* cited by examiner

*Primary Examiner*—Frederick L Lagman

(57) ABSTRACT

Disclosed is an expansion-sealed flood control gate, comprising a water board, a frame structure, two symmetrical constraint tracks, at least one encased expandable sealing tube, and a plurality of adapters. A U-shaped slot is formed between the two symmetrical constraint tracks for plugging in the water board. Each constraint track has a U-shaped expanding compression chamber connecting from one end to the other end to accommodate the tube inside. The adapters are connected with the open ends of the tube and fixed on the constraint tracks at the connected ends. Accordingly, there can be effectively repelled floods that the tube with the characteristics of active filling and uniform packing stress have the higher geometric tolerance, even if the slits between the water board, the constraint tracks and ground emerge the unexpected geometrical change, the encased expandable sealing tubes are ballooned to mend the slits.

20 Claims, 10 Drawing Sheets

EXPANSION-SEALED FLOOD CONTROL GATE

BACKGROUND OF THE INVENTION

1. Field of the Invention

The present invention relates to a barrier structure, and, more particularly, to an expansion-sealed flood control gate.

2. Description of the Related Art

Due to global warming effects, and as the global climate gradually changes, more flooding is occurring all over the world, and people are suffering from these natural disasters. In order to prevent flooding in buildings, people often use flood control gates at the entrance of the building. The typical flood control gate usually utilizes a water barrier overlaying method to deal with different flood heights and employs a heavy water barrier; as a result, the gap between each water barrier increases with the number of water barriers, which also increases the risk. In order to achieve ease of construction and lower construction costs, the traditional flood control gate design still utilizes right angled equipment for the corners; however, sharp bends in the compression strip causes uneven compression stress distributions across the compression strip. In addition, the junction of the compression strip at the corners are made by physical contact, therefore, the compression stresses at the conjunction are not completely not predictable or controllable, which is the basis of the most common leakage problems in traditional flood control gates.

The compression stresses on the traditional flood control gate is passive, which are generated according to the external forces. However, under partial water barrier weights, most external compression forces are applied on the water barrier at various points, which the water barrier then applies to the compression strip. In the traditional method, the compression stress value and the distance between each compression force application point are inversely proportional; in another words, when the distance is closer the compression stress values are higher, and vice versa. In order to solve this problem, more compression force application points and increased compression forces are the only two solutions. However, increasing the number of compression force application points causes an increased compression frequency, which results in longer construction times and higher material costs. Furthermore, increased compression forces causes compression stress concentration effects on local materials to be more severe at the compression force application points, which causes material fatigue and potential points of failure.

In addition, the longer the width of the flood control gate the more difficult it is for mechanical processes or construction applications to keep the gap constant or the gap to a minimum between the compression strip and the gate lip. Higher process accuracies lead to much higher equipment costs, and an increased strip thickness for gap adjustment purposes causes higher strip material costs. Another issue is, if the gate lip is accidently damaged and deformed during construction or later operations, the reliability of the damaged area becomes unpredictable. Therefore, based on either common experience or theoretical analysis, the more gaps generated in the construction of the flood control gate, the higher the associated risk. Therefore, both performance and maintenance issues for a stacked flood control gate are very worrying.

Therefore, it is desirable to provide an expansion-sealed flood control gate to mitigate and/or obviate the aforementioned problems.

SUMMARY OF THE INVENTION

A main objective of the present invention is to provide an expansion-sealed flood control gate which has the characteristics of active filling and uniform packing stresses that have higher geometric tolerances, even if the slits between the water board, the constraint tracks and the ground emerge under unexpected geometrical changes. Encased expandable sealing tubes balloon to mend the slits.

Another objective of the present invention is to provide an expansion-sealed flood control gate, which reinforces the entire structural strength to increase back support against water pressure and provide a double seal to prevent leakage.

Another objective the present invention is to provide an expansion-sealed flood control gate, which requires only screws, pins etc. for positioning; therefore, there are no worries concerning uneven compression forces and the assembly or maintenance is both easy and convenient.

To achieve the objective of the preset invention, an expansion-sealed flood control gate of the present invention comprises a water barrier, a frame structure, at least two constraint tracks, at least one encased expandable sealing tube and a plurality of adapters. The frame structure is installed onto the ground and at least two walls. The constraint tracks are installed on an inner side of the frame structure, a U-shaped slot is formed between the two constraint tracks and used for placement of the water barrier; wherein at least one constraint track includes an extended securing panel and a concave cover, and the concave cover, the frame structure and the water barrier form a U-shaped chamber with two connected ends. The encased expandable sealing tube is installed in the concave cover; wherein when the encased expandable sealing tube absorbs an in-flowing fluid the encased expandable sealing tube fills the U-shaped chamber to compress the edge of the water barrier. The adapters are connected to an open end of the encased expandable sealing tube and attached to the two ends of the constraint tracks.

Furthermore, the objective of the present invention can be achieved by following structure details.

In the expansion-sealed flood control gate, the constraint tracks are U-shaped, and the constraint tracks have curved corners.

Each constraint track comprises a horizontal track, two vertical tracks and two corners tracks.

The concave covers are disposed at both sides of the U-shaped slot without isolating the water barrier and the encased expandable sealing tube.

Each adapter is a module including a main body, a jacket and a fastening element; wherein the main body is inserted into a corresponding opening of the encased expandable sealing tube, and the jacket is placed on an outside of the corresponding opening of the encased expandable sealing tube to tightly seal the opening of the encased expandable sealing tube; and wherein the fastening element is used for securing the jacket to the corresponding end of the constraint track.

The insertion region of the main body has an enlarging head, and the jacket has a convergent opening matching to the enlarging head to clip the tube.

The main body of the adapter has a fitting used for providing an external connection without leakage.

The expansion-sealed flood control gate further comprises a pressure increasing device connected to the fitting so the encased expandable sealing tube evenly and completely expands to fully fill up the inside of the constraint track.

Each adapter further includes a tube bundle for tightening the jacket.

The expansion-sealed flood control gate further comprises a reinforcement mechanism for providing structural reinforcement to the water barrier.

The reinforcement mechanism includes a horizontal main reinforcement bar which is connected to both ends of the constraint tracks along the top of the water barrier, and a water barrier clip is installed on the front of the horizontal main reinforcement bar for preventing the water barrier from disengaging.

The reinforcement mechanism includes at least one vertical reinforcement module for providing support to the water barrier against water pressure.

The vertical reinforcement module comprises a vertical column, an inclined reinforcement column and a deflection compensation mechanism; wherein the deflection compensation mechanism is disposed on the top edge of the vertical column and pivoted to the inclined reinforcement column and is used for adjusting the height of a force point on the vertical column applied by the inclined reinforcement column.

A main body of the deflection compensation mechanism combined with the vertical column has two symmetric slots; and the deflection compensation mechanism further includes a slide block in the main body, a plurality of guiding slide rods disposed on two sides of the main body, and a rotatable bolt mounted on the main body; wherein the guiding slide rods are inserted through the slots and a pivot hole of the inclined reinforcement column and combined with an axle hole of the slide block, wherein the rotatable bolt has a bottom end in the main body for pushing against the slide block.

The vertical reinforcement module further comprises a lower quick-hinged mechanism disposed on the bottom edge of the vertical column for quickly obtaining support from a low anchor point.

The reinforcement mechanism includes at least one horizontal reinforcement bar module, which is used for providing horizontal structural reinforcement for the water barrier.

The horizontal reinforcement bar module comprises a horizontal structural main body, which is adapted for combination with the vertical column of the vertical reinforcement module or the constraint tracks to provide a meshed framework structure for the water barrier.

The horizontal reinforcement bar module further includes a hinged rocker arm disposed on one end of the horizontal structural main body and used for quickly hinging the horizontal structural main body to the anchor point of the constraint track.

The encased expandable sealing tubes are tubular hollow elements made of a thin film material with a low hardness, high elongation and high tensile strength, and used for filling up the surrounding U-shaped chamber when the elements expand.

The water barrier is made of a light weight and high strength material so it is easy to push the edge of the water barrier into the U-shaped slot.

The adapter can have a pressure meter for informing the pressure value in the encased expandable sealing tube.

The inside of the frame structure has a plurality of curved corner braces to ensure the constraint track is curly bent.

According to the above description, the expansion-sealed flood control gate of the present invention has following benefits and effects:

1. With the combination of the water barrier, the constraint tracks and the encased expandable sealing tube, since the post-expansion encased expandable sealing tube has filling and even compression force characterizes which means it has high geometry error tolerance; even geometric changes to the water barrier, the constraint tracks and the ground themselves, or the gaps in-between them, can be solved by the encased expandable sealing tube to prevent flooding and increase leakage-free reliability.

2. With the combination of the water barrier and the reinforcement mechanism, since the reinforcement mechanism includes at least one vertical reinforcement module and a horizontal reinforcement module; wherein two module are connected together to form a meshed framework, which provides a structural strength reinforcement to the water barrier, and the inclined reinforcement column of the vertical reinforcement module provides support to the water barrier against water pressure.

3. With the combination of the encased expandable sealing tube and the adapter, each encased expandable sealing tube has two ends, any of the expandable sealing tube is an independent seal, and two tracks provide double assurance. Moreover, the pressure meter can verify the sealing capability of the gate, which brings peace mind to the user.

4. With the combination of the water barrier, the constraint tracks and the reinforcement mechanism, since the disassembly of the gate only requires securing the bolts and the pins, there is no worry for low or uneven compression force causing leakage, and the simple assembly is easy for installation and maintenance.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
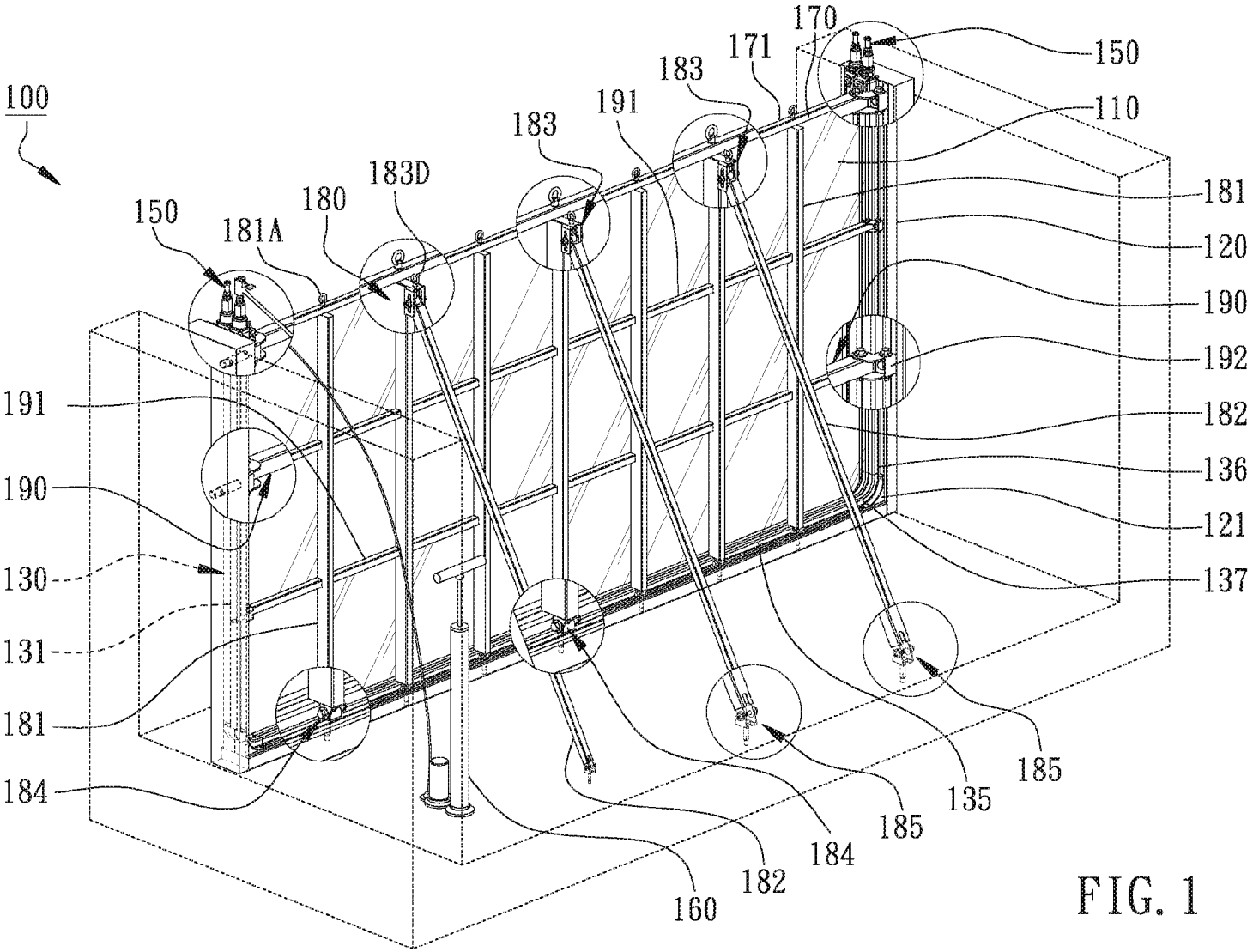
FIG. 1 is a perspective view of an expansion-sealed flood control gate according to an embodiment of the present invention.
Figure 2:
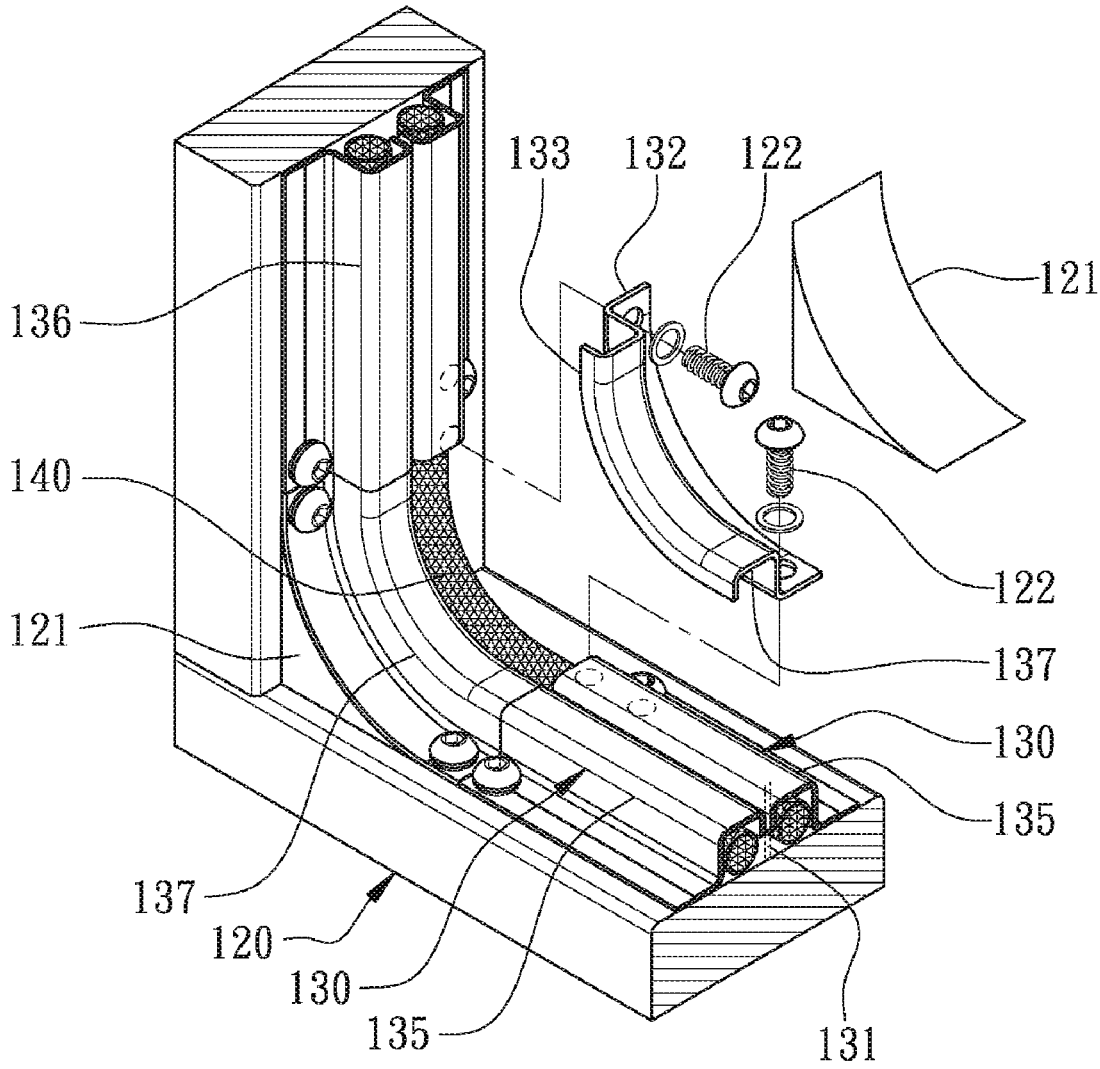
FIG. 2 is a detailed view of a constraint track and a corner track of an embodiment expansion-sealed flood control gate.

Please refer to FIG. 1 and FIG. 2. FIG. 1 is a perspective view of an expansion-sealed flood control gate according to an embodiment of the present invention. FIG. 2 is a detailed view of a constraint track and a corner track of the expansion-sealed flood control gate according to the embodiment of the present invention. An expansion-sealed flood control gate 100 comprises a water barrier 110, a frame structure 120, at least two constraint tracks 130, at least one encased expandable sealing tube 140 and a plurality of adapters 150. The water barrier 110 has direct contact with the water and is made of a light weight and high strength material which is easy to store and assemble. Preferably, the water barrier 110 is a transparent material to permit viewing of the water level. The water barrier 110 may be made of PC boards, which can be rolled up for storage, and so may require much less storage space while providing strength and which will not be affected by surface damage. As shown in FIG. 2, the frame structure 120 is used for ground installation and wall installation purposes. The frame structure 120 has civil structures perpendicular for the ground and the walls, and further has a plurality of curved corner braces 121 placed on the inner side of the frame structure 120 at the corners so that the constraint tracks 130 have rounded bends at the corners. As shown in FIG. 1, the frame structure 120 may be a pre-installed assembly to replace the original civil structure of ground/wall. The frame structure 120 is used for containing and positioning the constraint tracks 130. After the above-mentioned assembly process is completed, the expansion-sealed flood control gate 100 has basic water blocking capabilities. As shown in FIG. 2, the constraint tracks 130 are disposed on the inner side of the frame structure 120, and the gap between the constraint tracks 130 forms a U-shaped slot 131, which is used for placement of the water barrier 110. At least one constraint track 130 has an extended securing panel 132 and a concave cover 133, and the concave cover 133, the frame structure 120 and the water barrier 110 compose a U-shaped chamber 134 with two connecting ends. The U-shaped chamber 134 is used for containing the encased expandable sealing tube 140. When the water barrier 110 is not inserted in the U-shaped slot 131, the two sides of the concave cover 133 are connected. As shown in FIGS. 1 and 2, the constraint tracks 130 are U-shaped, and the constraint tracks 130 have curved corners. In this embodiment, the encased expandable sealing tubes 140 placed through the U-shaped chambers 134 are continuous elements and have no shape turns; therefore, there is no chance of leakage occurred at the right angle of the traditional gate.

Figure 3:
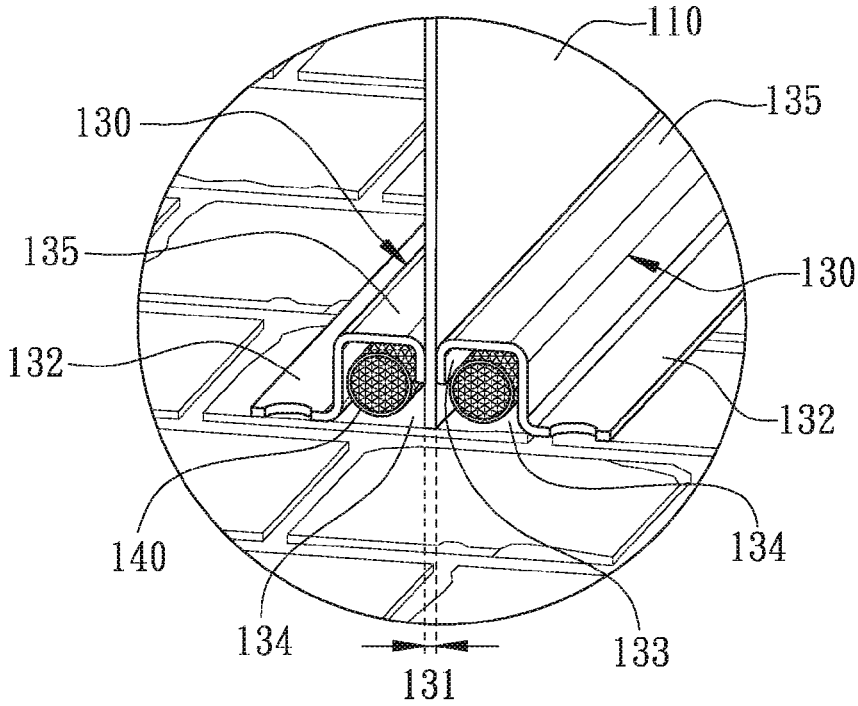
FIG. 3 is a detailed view of a pre-expansion encased expandable sealing tube of an embodiment expansion-sealed flood control gate.
Figure 4:
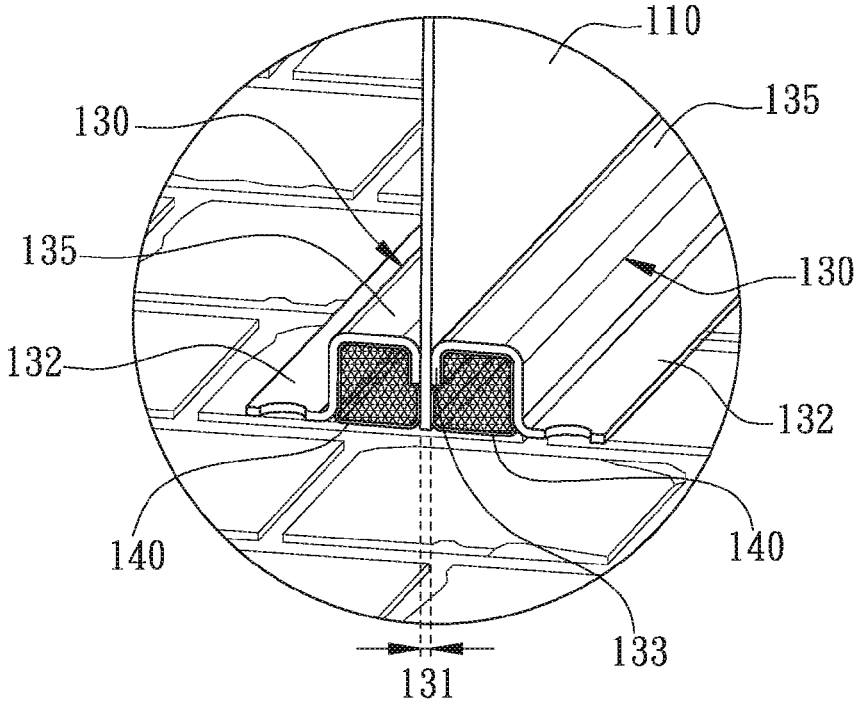
FIG. 4 is a detailed view of a post-expansion encased expandable sealing tube according to an embodiment of the present invention.

To be more specific, as shown in FIGS. 3 and 4, the concave covers 133 are placed on both sides of the U-shaped slot 131 and do not completely isolate the water barrier 110 from the encased expandable sealing tubes 140. Furthermore, the extended securing panel 132 provides space and positioning for a plurality of track securing screws or pins 122 so the extended securing panel 132 can be attached to the frame structure 120. The concave covers 133 are symmetrically placed to form the U-shaped slot 131 for placement of the water barrier 110. When the water barrier 110 is positioned, the water barrier 110, the concave cover 133 and the frame structure 120 form two symmetric U-shaped chambers 134. When the encased expandable sealing tubes 140 expand and completely fill up the U-shaped chambers 134, two independent U-shaped seals are formed. Even if one of the encased expandable sealing tubes 140 is damaged, the other encased expandable sealing tube 140 can still provide a single U-shaped seal to prevent leakage. More specifically, as shown in FIG. 2, the extended securing panel 132 can be locked onto the frame structure 120 via the track securing screws or pins 122 to secure the constraint tracks 130. Please refer again to FIGS. 1 and 2. Each constraint track 130 is composed of a horizontal track 135, two vertical tracks 136 and two corner tracks 137, which all correspond to the frame structure 120 having curved corner braces 121 to ensure that the cross-sectional shape of the U-shaped chambers 134 are identical. As a result, there are no right angle junctions as otherwise found in traditional flood control gates and which may cause leakage.

Please refer to FIGS. 3 and 4. The encased expandable sealing tubes 140 are placed in the constraint tracks 130 by way of the concave covers 133. The encased expandable sealing tubes 140 expands and fills the U-shaped chambers 134 by directing fluids to press against the edge of the water barrier 110. Fluids such as air, oil or water can be used for expanding the encased expandable sealing tubes 140, until the inner pressure value reaches a predetermined value, wherein air is the appropriate fluid. The encased expandable sealing tubes 140 may be tubular hollow elements made of a thin film material with a low hardness, high elasticity and high tensile strength, such as rubber, plastic etc., and are seamless and independent. The encased expandable sealing tubes 140 are placed continuously and unbroken in the U-shaped chambers 134. In this embodiment, the fluid is introduced by a high pressure gas source to expand the encased expandable sealing tubes 140 to fill the U-shaped chamber 134 (as shown in FIG. 4). In a different embodiment, a high pressure liquid source is utilized to expand the encased expandable sealing tubes 140. More specifically, as long as the introduced fluid in the encased expandable sealing tubes 140 has a higher pressure than the water pressure of the flood, the two water gaps at the edge of the water barrier 110 and the frame structure 120 will be isolated. Even if the user forgets to increase the pressure of the encased expandable sealing tubes 140 and as a consequence water is leaking, as long as the user immediately increases the pressure of any one of the encased expandable sealing tubes 140 to the predetermined pressure, such leakage can be stopped immediately. Preferably, the expanded encased expandable sealing tubes 140 has self-expand and even compress stress characteristics and higher geometric error tolerances. Even for geometric changes to the water barrier 110, the constraint tracks 130 and the frame structure 120 themselves, or the gaps in-between them (such as accidental dents, uneven surfaces on the frame, foreign debris, etc.) can be solved by the encased expandable sealing tubes 140 to prevent flooding and increase leakage-free reliability. The compression stresses applied to the encased expandable sealing tubes 140 for sealing are much lower than the compression stresses applied to traditional compression strips, and since an even compression force is generated by fluidic pressure (especially gas), there are no compression stress concentration effects on local materials or any related side effects that otherwise occur in typical flood control gates.

Please refer to FIGS. 3 and 4. When the water level rises above the constraint tracks 130, two leakage locations may occur: one is between the water barrier 110 and the constraint tracks 130; another is between the constraint tracks 130 and the frame structure 120. However, both gaps are sealed by the expanded encased expandable sealing tubes 140 with sufficient pressure. Therefore, the two independent constraint tracks 130 are provided to double sealing effect, and to increase leakage-free reliability. Even if any one of the encased expandable sealing tubes 140 fails and water leaks into the corresponding constraint track 130 and moves from the gap between the water barrier 110 and the frame structure 120 into another U-shaped chamber 134, as long as the encased expandable sealing tube 140 in this chamber 134 has the predetermined pressure, the flood control gate is still effective.

Figure 5:
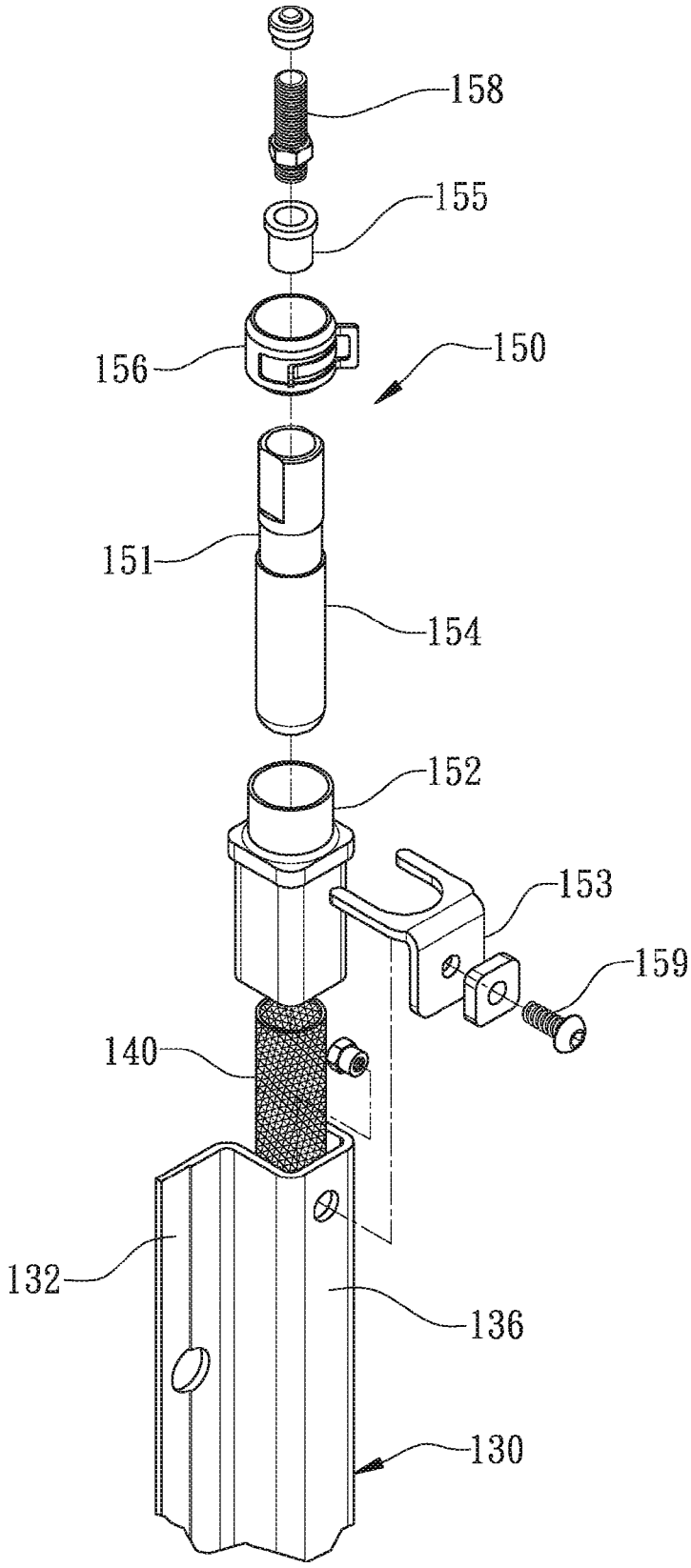
FIG. 5 is a detailed view of an adapter for an embodiment expansion-sealed flood control gate.
Figure 6:
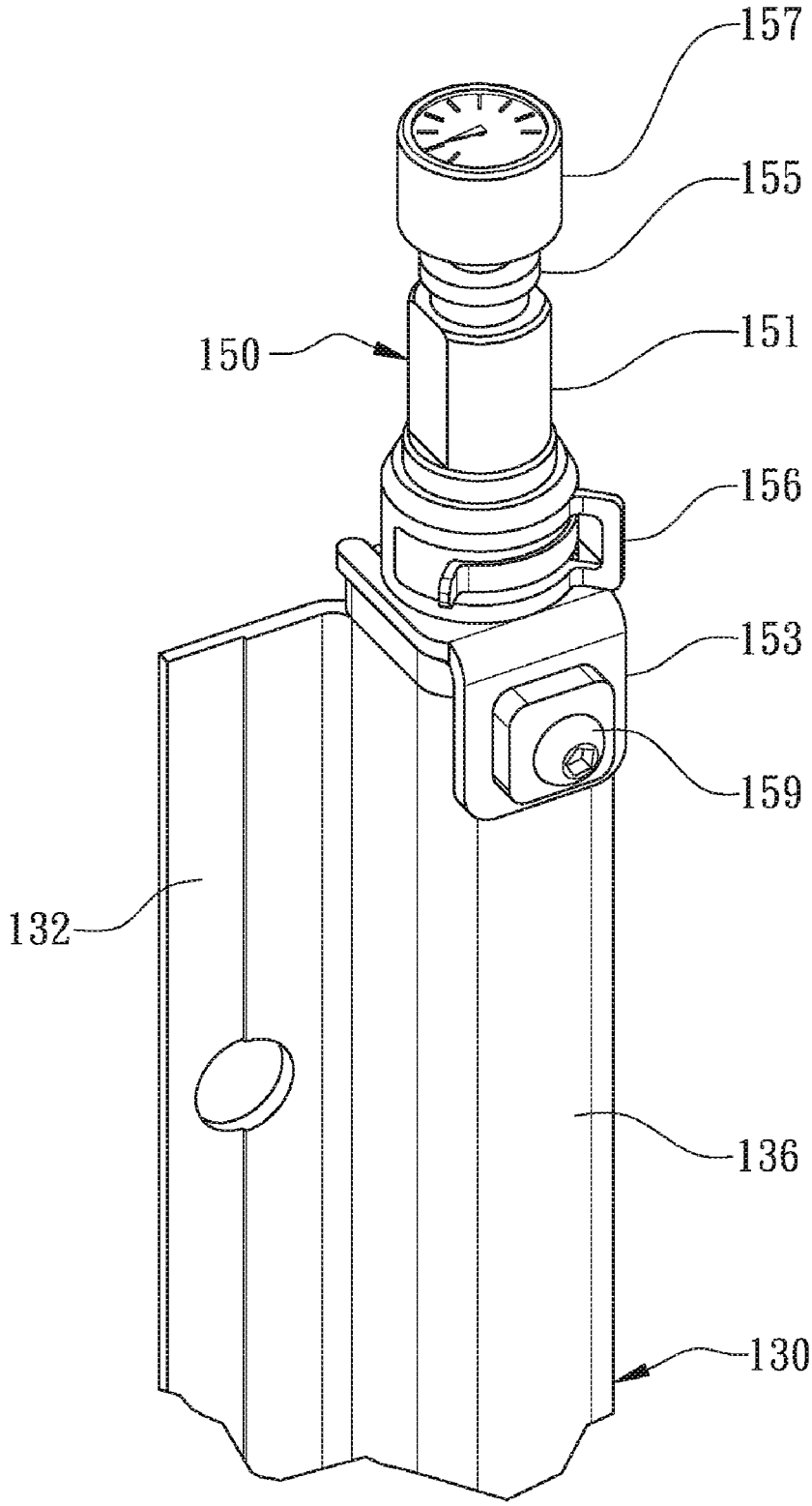
FIG. 6 is a perspective view of a pressure meter connected to an embodiment adapter.

Please refer to FIGS. 1 and 5. The adapters 150 are connected to a plurality of open ends of the encased expandable sealing tubes 140 and fastened on the constraint tracks 130 at the connected ends. In this embodiment, each adapter 150 is a module including a main body 151, a jacket 152 and a fastening element 153. The main body 150 is inserted into a corresponding opening of the encased expandable sealing tube 140; the jacket 152 is placed on an outside of the corresponding opening of the encased expandable sealing tube 140 to tightly seal the opening of the encased expandable sealing tube 140; and the fastening element 153 is used for securing the jacket 152 to the corresponding end of the constraint tracks 130 via a plurality of adapter securing screws or pins 159. Preferably, as shown in FIGS. 5 and 6, each adapter 150 further includes a tube bundle 156 for tightening the jacket 152 to indirectly secure the encased expandable sealing tube 140 therein again. Preferably, the insertion region of the main body 151 has an enlarging head 154, and the jacket 152 has a convergent opening matching to the enlarging head 154 to clip the tube 140. When the fluid pressure in the encased expandable sealing tube 140 increases, the relative moving distance with respect to the main body 151 also increases, and so the gap between the insertion region and the inner surface of jacket 152 decreases and the encased expandable sealing tube 140 between the main body 151 and the jacket 152 experiences higher compressive forces, in other words, a tighter engagement, which provides a self-locking effect. As shown in FIG. 5, the main body 151 of each adapter 150 further includes a fitting adapter 155, and the fitting adapter 155 is used for providing an external connection for the adapter 150 without leakage. The fitting adapter 155 may have different dimensions, which can be suitable for any size and device, such as an intake check adapter, a pressure meter, a pressure sensor, a safety valve, or a quick-release adapter. In this embodiment, a pressurizing device 160 (for example a pump as shown in FIG. 1) is connected to the fitting adapter 155 of the adapter 150 so the encased expandable sealing tubes 140 are evenly and thoroughly expanded in the constraint tracks 130 to seal the gaps of the constraint tracks 130 and the edges of the water barrier 110. More specifically, as shown in FIG. 5, the adapter 150 further includes an intake check adapter 156. The pressurizing device 160 is first connected to the intake check adapter 156, and then introduced into the encased expandable sealing tubes 140 via the fitting adapter 155. The pressurizing device 160 or other equivalent machine continuously introduces fluid into the encased expandable sealing tubes 140 until the predetermined pressure is reached, so the encased expandable sealing tubes 140 are evenly and thoroughly expanded in the U-shaped chamber 134 (as shown in FIG. 4) to seal the gaps at the edges of the constraint tracks 130, the frame structure 120 and the water barrier 110.

Moreover, a pressure meter 157 may be installed at the adapter 150 at the other end (as shown in FIG. 6) and used for showing the pressure value in the encased expandable sealing tubes 140, permitting the user to check whether the encased expandable sealing tubes 140 have reached the predetermined pressure. If the user notices the encased expandable sealing tubes 140 have insufficient pressure, he or she may need to perform a check up or repair. In another embodiment, the user can utilize an automatic control element to remotely control the pressure adjustment process of the pressurizing device 160, so he or she can monitor the expansion-sealed flood control gate 100 in real time.

Figure 7:
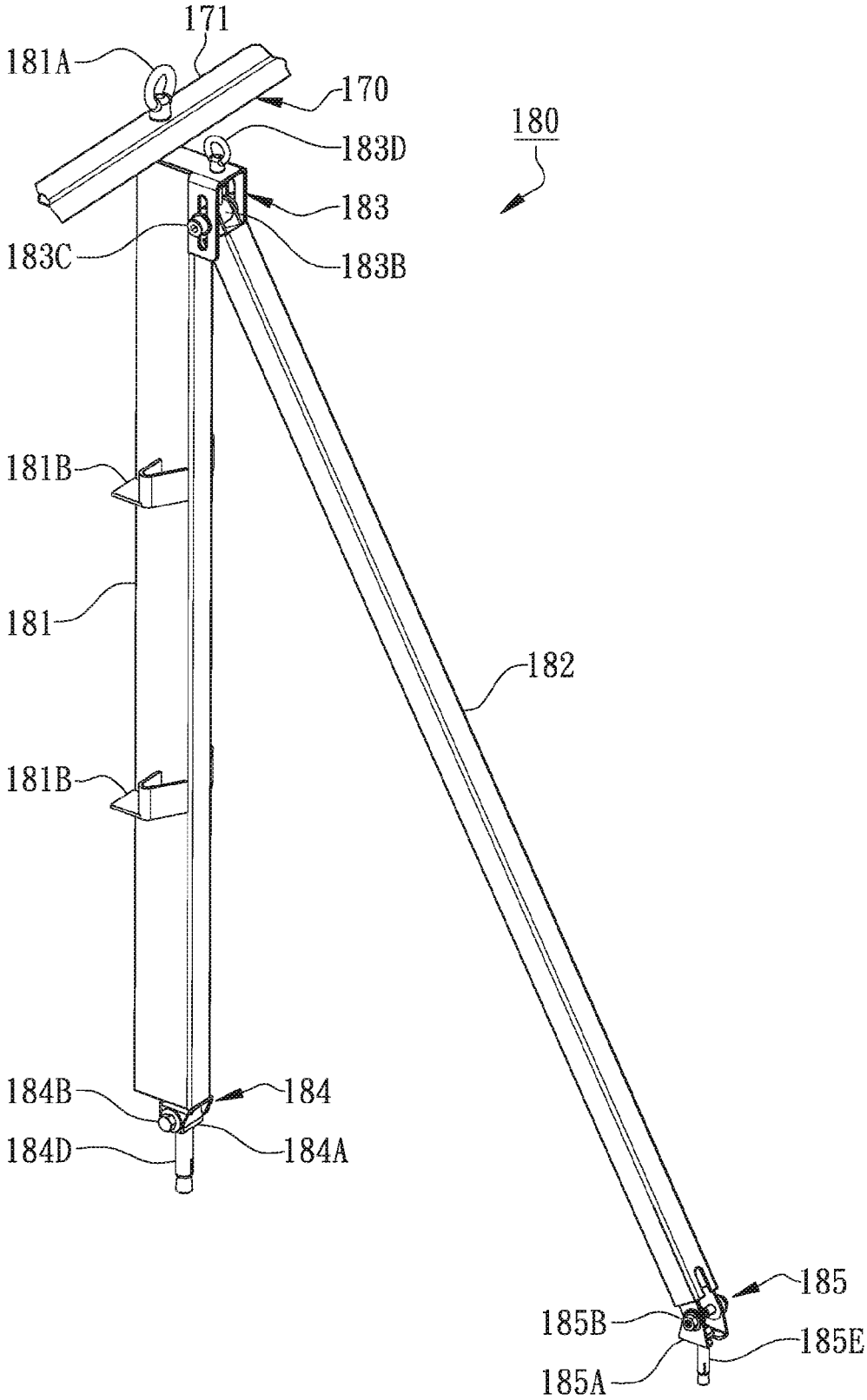
FIG. 7 is a perspective view of a vertical reinforcement module of an embodiment expansion-sealed flood control gate.
Figure 8:
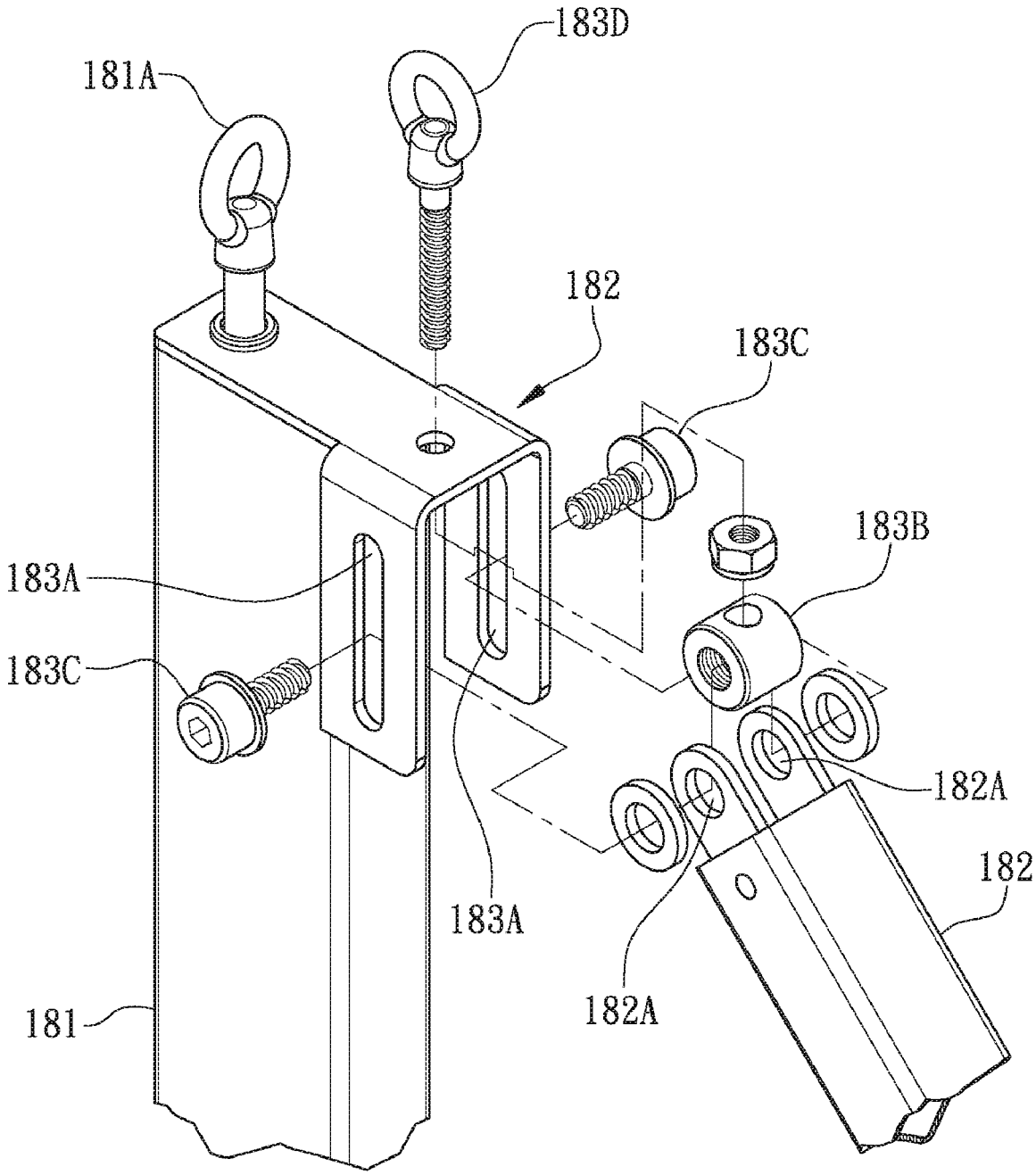
FIG. 8 is an exploded view of a deflection compensation mechanism of an embodiment expansion-sealed flood control gate.
Figure 9:
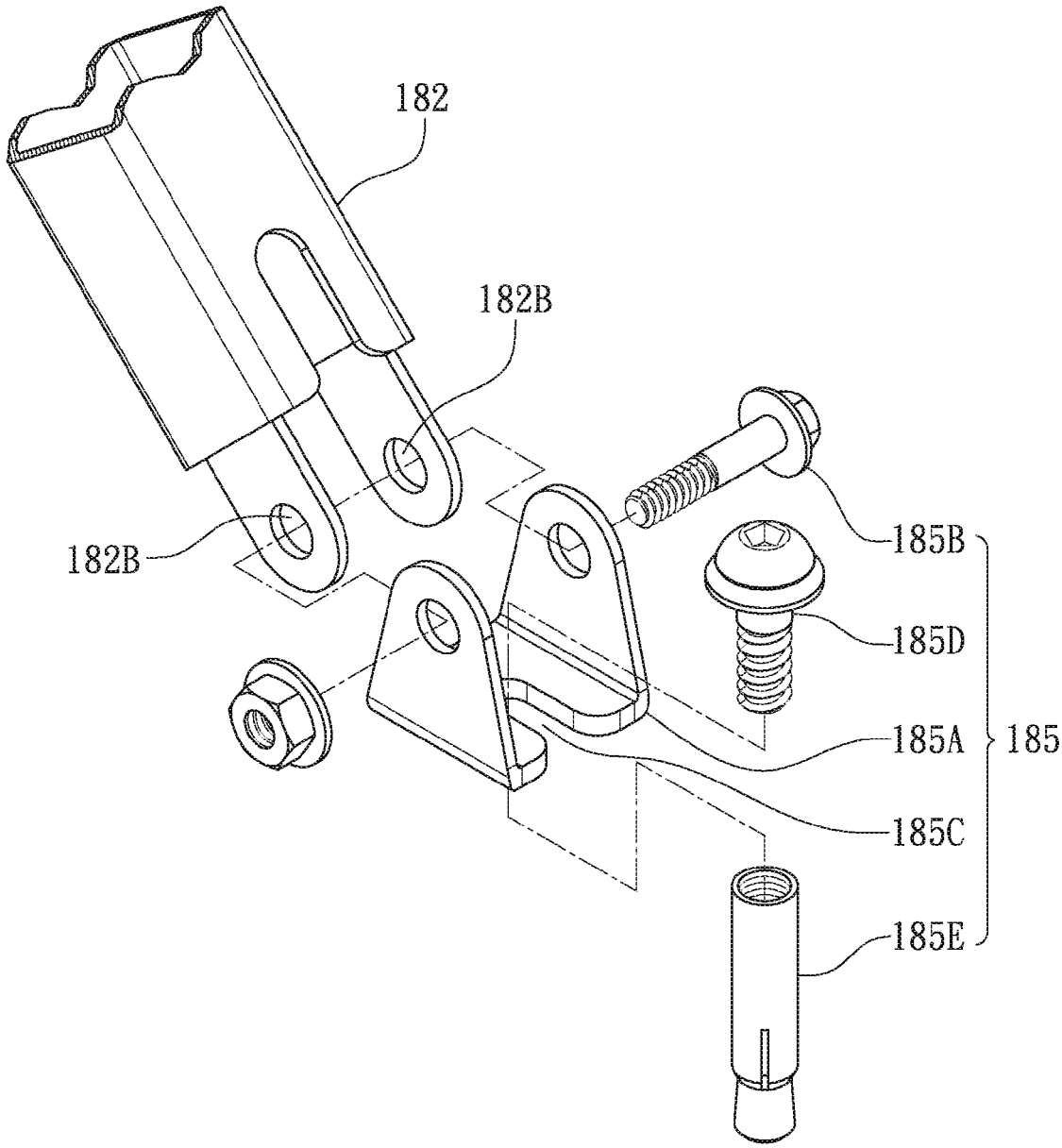
FIG. 9 is an exploded view of an inclined reinforcement column of an embodiment expansion-sealed flood control gate.
Figure 10:
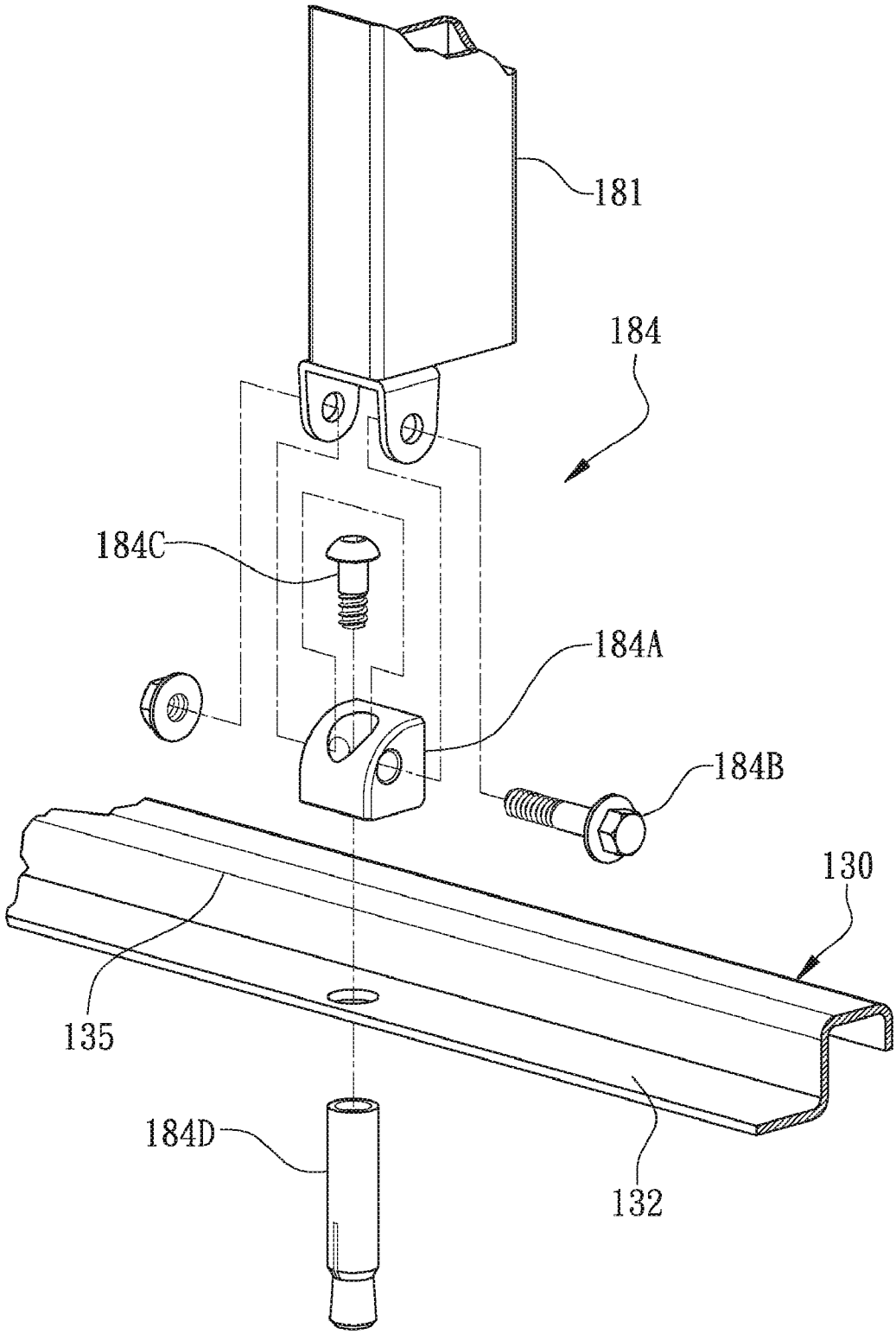
FIG. 10 is an exploded view of a lower quick hinged mechanism of an embodiment expansion-sealed flood control gate.

Preferably, the expansion-sealed flood control gate 100 further comprises a reinforcement mechanism (for example, the reinforcement mechanism is comprised of the vertical reinforcement module 180 and the horizontal reinforcement bar module 190 as shown in FIG. 1), which is used for providing structural reinforcement to the water barrier 110 and to prevent bending or deformation of the water barrier 110. Please refer to FIGS. 1 and 7. The reinforcement mechanism includes a horizontal main reinforcement bar 170 which is connected to both ends of the constraint tracks 130 along the top of the water barrier 110. And a water barrier clip 171 is installed on the front of the horizontal main reinforcement bar 170, and which is used to prevent disengagement of the water barrier 110. In this embodiment, the reinforcement mechanism further includes at least one vertical reinforcement module 180; the vertical reinforcement module 180 is securely attached to the main reinforcement bar 170 via a plurality of locking pins 181A and provides support to the water barrier 110 against water pressure. The vertical reinforcement module 180 comprises a vertical column 181, an inclined reinforcement column 182 and a deflection compensation mechanism 183. As shown in FIGS. 7 and 8, in this embodiment, the deflection compensation mechanism 183 is disposed on the top edge of the vertical column 181 and pivoted to the inclined reinforcement column 182 and is used for adjusting the height of the force point on the vertical column 181 applied by the inclined reinforcement column 182. The main body of the deflection compensation mechanism 183 combined with the vertical column 181 has two symmetric extended slots 183A, and the inclined reinforcement column 182 is moveably pivoted to the extended slots 183A of the deflection compensation mechanism 183. The deflection compensation mechanism 183 further includes a slide block 183B between the extended slots 183A, a plurality of guiding slide rods 183C disposed on two sides of the main body, and a rotatable bolt 183D mounted on the main body. With the guiding slide rods 183C being inserted through the slots 183A and a pivot hole 182A of the inclined reinforcement column 182 and combined with an axle hole of the slide block 183B, a bottom end of the rotatable bolt 183D is used for pushing against the slide block 183B. The rotation depth of the rotatable bolt 183D can adjust the height of a force point (corresponding to the slide block 183B) on the vertical column 181 applied by the inclined reinforcement column 182. More specifically, the structure of the expansion-sealed flood control gate 100 is weaker in the direction at which water pressure is applied; when the water level is higher, and the span is longer, so the deflection generated by the expansion-sealed flood control gate 100 is higher. Through the deflection compensation mechanism 183, by use of the rotatable bolt 183D to adjust the force point on the vertical column 181 applied by the inclined reinforcement column 182, provides the different geometric rigidity to compensate for the deflection generated by the expansion-sealed flood control gate 100. Furthermore, as shown in FIG. 9, each inclined reinforcement column 182 utilizes a stopping bolt 185D attached to an inclined stop 185. In this embodiment, a lower connecting hole 182B is placed at the lower edge of the inclined reinforcement column 182, the inclined stop 185 includes a stopping base 185A and a pivoting bolt 185B, and the pivoting bolt 185B is placed though the lower connecting hole 182B and the stopping base 185A to hinge the inclined reinforcement column 182 with the inclined stop 185. Therefore, whether the incline angle of the inclined reinforcement column 182 needs to be adjusted during the assembly or the horizontal angle of the ground has changed, the bottom of the stopping base 185A can always completely touch the ground. As shown in FIG. 1, the stopping bolt 185D is normally locked with an expandable bolt 185E buried in the ground; for assembly purposes, the user unbolts the stopping bolt 185D, moves along a groove 185C of the stopping base 185A until the stopping base 185A sets, and finally screws the stopping bolt 185D tightly. Accordingly, when the water pressure is pushing the water barrier 110, the inclined stop 185 can transfer the reaction force in the horizontal and the vertical directions to the vertical reinforcement module 180 via the combination of the stopping bolt 185D and the corresponding expandable bolt 185E, to provide enough back support to the water barrier 110 against water pressure. Please refer again to FIGS. 1 and 10. The vertical reinforcement module 180 further includes a lower quick hinged mechanism 184 disposed on the bottom edge of the vertical column 181, which is used to quickly obtain support from a low anchor point. In this embodiment, each lower quick hinged mechanism 184 comprises a ground hinged block 184A and a hinged bolt 184B. The ground hinged block 184A is attached via a fastening pin 184C to an expandable bolt 184D buried in the ground. The hinged bolt 184B is used as pivot shaft and placed through the correspond hole on the lower end of the vertical column 181 and the ground hinged block 184A, so the vertical column 181 is mounted on the ground hinged block 184A.

Figure 11:
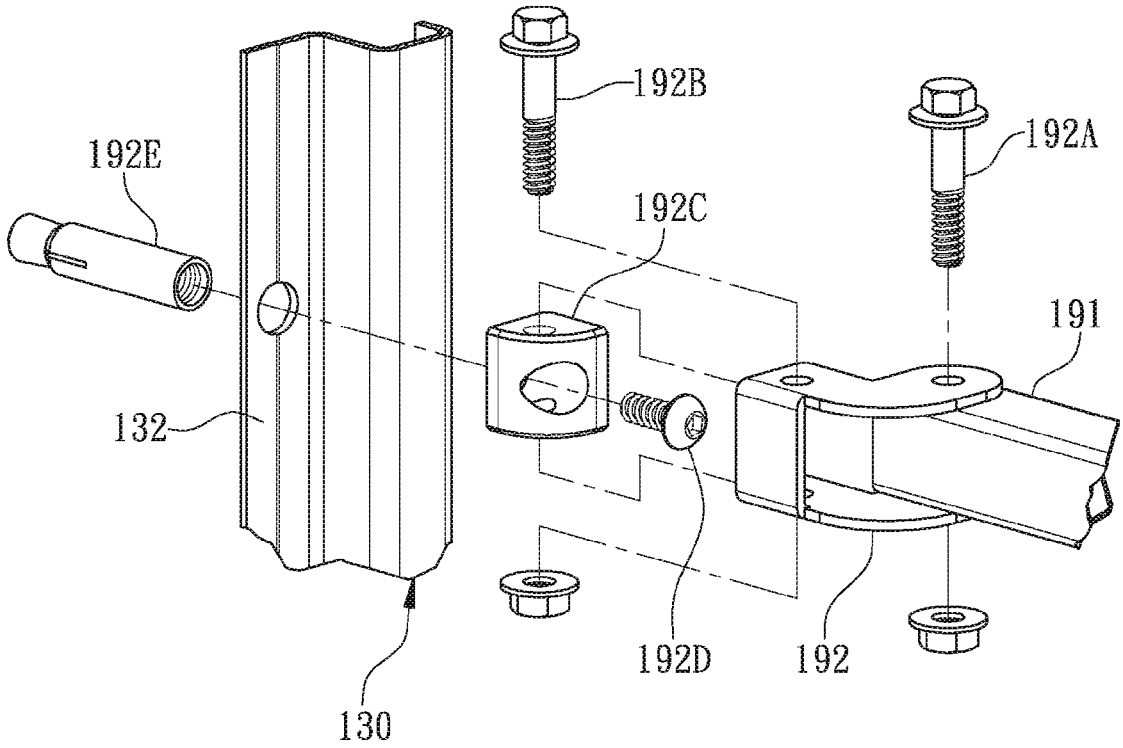
FIG. 11 is an exploded view of a horizontal reinforcement bar module of an embodiment expansion-sealed flood control gate.

Please refer to FIGS. 1 and 11. The reinforcement mechanism further includes at least one horizontal reinforcement bar module 190, which is used for providing horizontal structural reinforcement for the water barrier 110. The horizontal reinforcement bar module 190 comprises a horizontal structural main body 191, which is adapted for combination with the vertical column 181 of the vertical reinforcement module 180 or the constraint tracks 130. For example, a plurality of rods are placed between the vertical columns 181 and between the outermost vertical columns 181 and the vertical tracks 136 of the constraint tracks 130, to provide a meshed framework structure to the water barrier 110. In this embodiment, as shown in FIG. 7, each vertical column 181 further includes a plurality of fastening elements 181B, and each fastening elements 181B has a horizontal supporting face and a vertical fastening face. As shown in FIGS. 1 and 7, the horizontal structural main body 191 of the horizontal reinforcement bar module 190 further includes a plurality of sectional rods, and the sectional rods between the vertical columns 181 can be fastened and placed in the fastening elements 181B without extra engaging elements. In this embodiment, with reference to FIG. 1, each horizontal reinforcement bar module 190 further includes a hinged rocker arm 192. And, as shown in FIG. 11, the hinged rocker arm 192 is connected to one end of the horizontal structural main body 191 via a engaging pin 192A, and this engaging end of the horizontal structural main body 191 is one end of the rod between the outermost vertical column 181 and the vertical track 136 of the constraint tracks 130 (as shown in FIG. 1). Furthermore, the hinged rocker arm 192 is pivoted to a hinging block 192C via a hinged bolt 192B. The hinging block 192C is attached to an expandable bolt 192E buried in the wall by a securing pin 192D. With the combination of the hinged rocker arm 192 and hinging block 192C, an anchor point is formed on the constraint tracks 130 so the horizontal structural main bodys 191 can quickly be hinged to the anchor point of the constraint tracks 130. Therefore, the reinforcement mechanism (including the vertical reinforcement module 180 and the horizontal reinforcement bar module 190) is very easy to assemble, providing a water barrier 110 free from leakage caused by a weak structure or uneven compressive forces, and the light weight and simple assembly mechanism is convenient for installation or maintenance purposes.

Although the present invention has been explained in relation to its preferred embodiment, it is to be understood that many other possible modifications and variations can be made without departing from the spirit and scope of the invention as hereinafter claimed.

What is claimed is:

1. An expansion-sealed flood control gate comprising:

a water barrier;

a frame structure for installing onto the ground and at least two walls;

at least two constraint tracks installed on an inner side of the frame structure, a U-shaped slot formed between the two constraint tracks and used for placement of the water barrier; wherein at least one constraint track includes an extended securing panel and a concave cover, and the concave cover, the frame structure and the water barrier form a U-shaped chamber with two connected ends;

at least one encased expandable sealing tube installed in the concave cover, wherein the tube fills up the U-shaped chamber and compresses the edges of the water barrier by filling with an in-flowing fluid; and a plurality of adapters connected to a plurality of open ends of the tube and fastened on the constraint tracks at the connected ends.

2. The expansion-sealed flood control gate as claimed in claim 1, wherein the constraint tracks are U-shaped, and the constraint tracks have a plurality of curved corners.

3. The expansion-sealed flood control gate as claimed in claim 2, wherein each constraint track comprises a horizontal track, two vertical tracks and two corners tracks.

4. The expansion-sealed flood control gate as claimed in claim 1, wherein the concave covers are disposed to form both sides of the U-shaped slot without isolating the water barrier and the encased expandable sealing tube.

5. The expansion-sealed flood control gate as claimed in claim 1, wherein each adapter is a module including a main body, a jacket and a fastening element, wherein the main body is inserted into a corresponding opening of the tube, and the jacket is placed on an outside of the corresponding opening of the tube to tightly seal the opening, and wherein the fastening element secures the jacket to the corresponding end of the constraint track.

6. The expansion-sealed flood control gate as claimed in claim 5, wherein the insertion region of the main body has an enlarging head, and the jacket has a convergent opening matching to the enlarging head to clip the tube.

7. The expansion-sealed flood control gate as claimed in claim 5, wherein each adapter further includes a fitting connecting with the main body for providing an external connection without leakage.

8. The expansion-sealed flood control gate as claimed in claim 7 further comprising a pressure increasing device connected to the fitting so the tube evenly and completely expands to fully fill up the inside of the constraint track.

9. The expansion-sealed flood control gate as claimed in claim 5, wherein each adapter further includes a tube bundle for tightening the jacket.

10. The expansion-sealed flood control gate as claimed in claim 1 further comprising a reinforcement mechanism for providing structural reinforcement to the water barrier.

11. The expansion-sealed flood control gate as claimed in claim 10, wherein the reinforcement mechanism includes a horizontal main reinforcement bar which is connected to both ends of the constraint track along the top of the water barrier, and a water barrier clip is installed on the front of the horizontal main reinforcement bar for preventing the water barrier from disengaging.

12. The expansion-sealed flood control gate as claimed in claim 10, wherein the reinforcement mechanism includes at least one vertical reinforcement module for providing support to the water barrier against water pressure.

13. The expansion-sealed flood control gate as claimed in claim 12, wherein the vertical reinforcement module includes a vertical column, an inclined reinforcement column and a deflection compensation mechanism; wherein the deflection compensation mechanism is disposed on the top edge of the vertical column and pivoted to the inclined reinforcement column and is used for adjusting the height of a force point on the vertical column applied by the inclined reinforcement column.

14. The expansion-sealed flood control gate as claimed in claim 13, wherein a main body of the deflection compensation mechanism combined with of the vertical column has two symmetric slots; and the deflection compensation mechanism further includes a slide block in the main body, a plurality of guiding slide rods disposed on two sides of the main body, and a rotatable bolt mounted on the main body; wherein the guiding slide rods are inserted through the slots and a pivot hole of the inclined reinforcement column and combined with an axle hole of the slide block; wherein the rotatable bolt has a bottom end in the main body for pushing against the slide block.

15. The expansion-sealed flood control gate as claimed in claim 13, wherein the vertical reinforcement module further includes a lower quick-hinged mechanism disposed on the bottom edge of the vertical column for quickly obtaining support from a low anchor point.

16. The expansion-sealed flood control gate as claimed in claim 12, wherein the reinforcement mechanism includes at least one horizontal reinforcement bar module, which is used for providing horizontal structural reinforcement for the water barrier.

17. The expansion-sealed flood control gate as claimed in claim 16, wherein the horizontal reinforcement bar module includes a horizontal structural main body, which is adapted for combination with the vertical column of the vertical reinforcement module or the constraint tracks to provide a meshed framework structure for the water barrier.

18. The expansion-sealed flood control gate as claimed in claim 17, wherein the horizontal reinforcement bar module further includes a hinged rocker arm disposed on one end of the horizontal structural main body and used for quickly hinging the horizontal structural main body to the anchor point of the constraint track.

19. The expansion-sealed flood control gate as claimed in claim 1, wherein the tube is a tubular hollow element made of a thin film material with low hardness, high elongation and high tensile strength, and used for filling up the surrounding U-shaped chamber when the tube expands.

20. The expansion-sealed flood control gate as claimed in claim 1, further comprising a plurality of curved corner braces disposed on the inside corners of the frame structure to ensure the constraint tracks are curly bent.

* * * * *